US010138094B2

(12) United States Patent
Eberharter et al.

(10) Patent No.: US 10,138,094 B2
(45) Date of Patent: Nov. 27, 2018

(54) CRANE AND METHOD FOR CRANE CONTROL

(71) Applicant: Liebherr-Werk Nenzing GmbH, Nenzing (AT)

(72) Inventors: Johannes Karl Eberharter, Satteins (AT); Klaus Schneider, Hergatz (DE)

(73) Assignee: Liebherr-Werk Nenzing GmbH, Nenzing (AT)

( * ) Notice: Subject to any disclaimer, the term of this patent is extended or adjusted under 35 U.S.C. 154(b) by 657 days.

(21) Appl. No.: 13/781,355

(22) Filed: Feb. 28, 2013

(65) Prior Publication Data

US 2013/0233820 A1 Sep. 12, 2013

(30) Foreign Application Priority Data

Mar. 8, 2012 (DE) ..... 10 2012 004 739

(51) Int. Cl.
*B66C 13/18* (2006.01)
*B66C 13/46* (2006.01)
*B66C 23/26* (2006.01)

(52) U.S. Cl.
CPC ..... *B66C 13/18* (2013.01); *B66C 13/46* (2013.01); *B66C 23/26* (2013.01)

(58) Field of Classification Search
CPC ..... B66C 13/18; B66C 13/46; B66C 23/26
See application file for complete search history.

(56) References Cited

U.S. PATENT DOCUMENTS

2010/0095835 A1* 4/2010 Yuan ..... B66C 13/06 91/392
2011/0006024 A1* 1/2011 Schneider ..... B66C 13/063 212/272

FOREIGN PATENT DOCUMENTS

| | | | |
|---|---|---|---|
| DE | 19842436 | A1 | 3/2000 |
| DE | 19931301 | A1 | 1/2001 |
| DE | 102006040782 | A1 | 3/2008 |
| DE | 202008008174 | U1 | 11/2009 |
| DE | 102009016366 | A1 | 12/2009 |
| GB | 2050294 | A | 1/1981 |
| JP | 2008189401 | A * | 8/2008 |

OTHER PUBLICATIONS

German Patent and Trademark Office, Search Report of DE102012004739.8, dated Jan. 25, 2013, Germany, 5 pages.

* cited by examiner

*Primary Examiner* — Michael R Mansen
*Assistant Examiner* — Nathaniel L Adams
(74) *Attorney, Agent, or Firm* — McCoy Russell LLP

(57) ABSTRACT

The present disclosure relates to a method for the control and/or the data acquisition of a crane, wherein at least one measuring device at the crane supplies one or more measured values for determining the position of at least one load lifting device, in particular a crane hook, wherein a calculation of the position of the load lifting device is effected on the basis of the one or more measured values of at least one measuring device and one or more data characterizing the stiffness of the crane. The present disclosure also relates to a crane controller and a crane for carrying out the method according to the present disclosure.

19 Claims, 2 Drawing Sheets

CRANE AND METHOD FOR CRANE CONTROL

CROSS REFERENCE TO RELATED APPLICATION

This application claims priority to German Patent Application No. 10 2012 004 739.8, entitled "Crane and Method for Crane Control," filed Mar. 8, 2012, which is hereby incorporated by reference in its entirety for all purposes.

TECHNICAL FIELD

This present disclosure relates to a method for the control and/or data acquisition of a crane, wherein at least one measuring device at the crane supplies one or more measured values for determining the position of a load lifting device. The subject-matter of the present disclosure also is directed to a corresponding crane and a suitable crane controller.

BACKGROUND AND SUMMARY

The determination of the exact hook position during the crane operation is an essential prerequisite for an automated crane control method.

Up to now, the height of the crane hook as a function of the radius from the crane, usually referred to as outreach, is calculated by geometric relations of the crane body. For this calculation, however, a rigid crane body is assumed.

During operation of the crane, the entire crane system or individual crane components is/are exposed to extreme loads caused by applied forces. The same however cause a considerable deformation of the geometric shape of the crane, which then leads to inaccuracies in the calculation of the position.

An increased need for safety during operation of the crane and particular crane operations regularly call for a determination of the position of the load lifting device as precisely as possible during the operation. In particular, a reliable lifting force limiter requires an exact determination of the hook position. In addition, a correct determination of the crane hook position is required in particular in a tandem operation of two cranes.

It is the object of the present disclosure to indicate a method for determining the current position of a load lifting device, which permits a more exact position determination as compared to the known methods.

This object is solved by a method for the control and/or data acquisition of a crane, wherein at least one measuring device at the crane supplies one or more measured values for determining the position of at least one load lifting device, for example a crane hook, wherein a calculation of the position of the load lifting device is effected on the basis of the one or more measured values of at least one measuring device and one or more data characterizing the stiffness of the crane.

Accordingly, the present disclosure is based on the fact that at least one measuring device at the crane supplies one or more measured values for determining the position of at least one load lifting device.

As load lifting device a crane hook preferably is used, but alternative load lifting device are conceivable, such as for example a supporting frame, a crossbeam, a grab, a magnetic lifting means, etc.

According to the present disclosure, a calculation of the exact position of at least one load lifting device is effected on the basis of the one or more measured values of at least one measuring device and one or more data characterizing the stiffness of the crane. Preferably, among the data characterizing the stiffness of the crane, values generally are meant which describe a deviation of the crane geometry during operation of the crane from the normal rigid form of the crane.

In this connection, data characterizing the stiffness of the crane in particular comprise data which relate to the bending and/or tensile and/or torsional stiffness of the crane or certain crane components or provide a measure for the bend and/or elongation and/or torsion of the crane or certain crane components.

It is also possible to consider a spring constant of the crane or a crane component as the data characterizing the stiffness of the crane.

Accordingly, the method turns away from the previous assumption of a rigid crane structure and instead considers influences on the crane structure, in particular the effects of the applied forces on the crane geometry and the related deformation of the geometric crane shape, in order to provide for a more precise determination of the position of the load lifting device.

The position of the load lifting device preferably is calculated in radial direction R to the crane and in vertical direction V relative to the crane or as absolute value in vertical direction H.

Data characterizing the stiffness of the crane preferably relate to the bend or bending stiffness of at least one crane component. Possible crane components in this connection include the crane tower or individual tower elements as well as the boom system or individual boom elements.

Furthermore, the data characterizing the stiffness of the crane may consider the suspension of one or more crane components. In this connection, at least one outrigger of the crane should be mentioned. In particular, the suspension of at least one support arm and possibly the suspension of the support mechanism, for example of the corresponding support cylinder, should be taken into account.

Said crane components are subject to deformations which can be determined in dependence on the suspended load mass and position.

The data characterizing the stiffness, in particular the tensile stiffness, of the crane also can include the condition of at least one hoisting cable. Here, the total stiffness and in particular the cable sag and/or the cable elongation and/or the tensile stiffness of at least one hoisting cable can contribute to an improved representation of the crane system and help to achieve a more precise position determination of the load lifting device used.

One or more data characterizing the stiffness of the crane preferably can be detected by one or more suitable measuring devices during operation of the crane and be employed for calculating the position of the load lifting device.

Alternatively, a crane model considering the crane stiffness can be generated and be taken into account for the calculation of the position of the load lifting device. For example, the calculation of the position of the load lifting device can be based on a real-time model being simulated in the crane controller, the model including the crane stiffness. Modeling the crane condition involves the advantage that a limited number of sensors is sufficient for the exact determination of the position of the load lifting device. By using deformable crane models, a more realistic calculation can be achieved.

For modeling, one or more crane components for example can be represented as elastic elements, preferably beams.

Due to the realistic modeling of the crane system, the bend of the elements or beams is considered in the calculation of the position of the load lifting device.

For example, one or more tower elements of the crane are interpreted as beams whose bend is simulated in a known way. In addition, the elements of a boom system preferably can likewise be understood as individual beams whose deflection can be determined.

Expediently, the support system, in particular individual support arms or associated support cylinders are modeled as resilient or damping elements.

Furthermore, extensible elements can be employed for generating a crane model, wherein the extensible elements in particular represent the condition of at least one hoisting cable. Preferably, a possible cable sag and/or a possible cable elongation of at least one hoisting cable thereby is considered in the crane model.

For determining the position of the load lifting device certain parameters describing the crane condition may be required. Preferably, at least one measuring device arranged at the crane detects the suspended load mass. In addition, the boom erection angle can metrologically be detected, in particular by means of at least one measuring device arranged at the crane and provided for this purpose. Of course, the crane inclination—for example when mounted on a ship—also can be detected, in order to take account of the same.

As has already been explained above, the exact position of the load lifting device is described by the radial distance R to the crane and the vertical height H of the load lifting device. The bend of the boom system and/or the bend of the crane tower and possibly the spring or damping movement of the supporting device can be calculated for example by taking into account the load mass and possibly the boom erection angle. In this case, load mass and/or boom erection angle expediently are determined directly or indirectly by measurement.

The radial distance R of the load lifting device to the crane then can be determined with reference to the measured values and the calculated or modulated bend or spring and damping movement, in particular be derived from the previously determined values by means of transformation.

In one embodiment of the method it is conceivable that at least one measuring device detects the unwound hoisting cable length.

The cable elongation and/or the cable sag of at least one hoisting cable can be calculated or modeled in dependence on the detected value for the unwound hoisting cable length and taking into account the determined distance R. The height H of the load lifting device then can be derived from the calculated values, in particular by calculations.

The method of the present disclosure accordingly provides for a particularly exact determination of the coordinates R and H. The method requires no installation of additional sensors, but the position determination can be carried out by means of the usual sensors.

In principle, it is possible to metrologically detect individual model parameters and/or derive the same with reference to certain measured values. It may be expedient to detect the bend of the crane tower or the boom system by suitable measuring device. The same applies to parameters which characterize both resilient or damping elements and/or extensible elements.

An exact position determination of the load lifting device in particular is desirable in so-called multi-crane controllers, as in these cases minor deviations of the actual position of the common load or load lifting device from a position determined by the controller can lead to a considerable endangerment of the crane operation. The method according to the present disclosure is suitable in particular for controlling a tandem crane system. Furthermore, the use of the method according to the present disclosure is expedient in particular when implementing grab controllers or lifting force limiters.

The present disclosure furthermore relates to a crane controller for a crane for carrying out the method described above. Accordingly, the advantages and details of the method according to the present disclosure quite obviously apply to the execution of the crane control according to the present disclosure, which is why a renewed description will be omitted at this point.

Furthermore, the present disclosure is directed to a crane with such crane controller. Accordingly, the advantages and properties of the method according to the present disclosure analogously apply to the design of the crane according to the present disclosure.

It is particularly advantageous when at least one measuring device of the crane includes one or more DMS elements. The arrangement of individual strain gauges at the crane system allows an easy detection of the deformation, in particular bend, of certain crane components. In particular, the arrangement at the boom system or at individual elements of the boom system is expedient. In addition, the use of one or more strain gauges at the crane tower is suitable to detect the bend of the crane tower or individual crane tower elements.

It is furthermore advantageous when at least one measuring device comprises a sensor unit arranged at the retracting mechanism. Such sensor unit allows the measurement of the unwound cable length, which is taken into account in particular for calculating the height H of at least one load lifting device, in particular of a crane hook. Respective measured values likewise or alternatively can be supplied by one or more cable pulleys.

In addition, a sensor unit expediently can be provided at the luffing gear, in order to measure the condition of the luffing gear or the luffing angle of the boom system. What is also possible is an angle sensor which is mounted at the boom system or at the luffing joint and detects the actual erection angle of the boom system.

A further subject-matter of the present disclosure relates to a tandem crane system which consists of at least two cranes. According to the present disclosure, at least one crane or the entire tandem crane system includes at least one crane controller according to any of the advantageous embodiments described above. Two or more cranes preferably are operated by a uniform crane controller and hence can simultaneously be controlled by a crane operator.

The present disclosure furthermore relates to a data carrier with a stored software for a crane controller, which is suitable for carrying out the method according to the present disclosure or an advantageous embodiment of the method according to the present disclosure. The advantages and properties of the claimed data carrier hence correspond to those of the method according to the present disclosure.

Further advantages and details of the present disclosure will be described in detail with reference to the following drawings.

DETAILED DESCRIPTION

The method according to the present disclosure will be illustrated in more detail with reference to a conventional crane. The crane comprises a vertical crane tower which is mounted on a turntable rotatable relative to the undercarriage. The undercarriage is designed with a corresponding supporting device of individual support arms and corresponding support cylinders for operating the support arms. The turntable is connected with the undercarriage via a slewing ring. Furthermore, the crane comprises a boom which is luffably attached to the crane tower by means of a luffing gear. The hoisting cable extends proceeding from the cable winch via a plurality of cable pulleys at the crane tower over the tower tip up to the tip of the boom system. At the end, a crane hook is attached as load lifting device. The hoisting cable can be divided into three individual cable pieces, in particular the cable portion along the crane tower, the cable portion between tower and boom tip, and the cable portion between boom tip and crane hook, wherein the cable pieces generally are designed as block and tackle system.

The crane furthermore has a crane controller which at least is responsible for the essential control tasks. The controller may include computer readable storage medium including code stored therein for carrying out the methods described herein, and generating actions such as calculating a position of the load lifting device, and adjusting crane operation or displaying information based on the calculated position. Thus, a part of the control tasks requires that the controller knows about the actual position of the load or the load lifting device. For this purpose, the controller has a corresponding module which determines the current position of the load lifting device during operation of the crane, and adjusts crane operation or displays crane information based on the determined current position.

So far, the height of the crane hook has been calculated as a function of the radial distance of the crane hook to the crane, i.e. the crane outreach, on the basis of the geometric relations of the crane structure. There has always been assumed a rigid crane model, which always maintains its original geometric configuration. However, the crane deformations occurring in reality due to the applied forces, in particular the load mass, only are considered insufficiently or neglected completely. Disadvantageously, this leads to considerable inaccuracies in the position determination.

Figure 1:
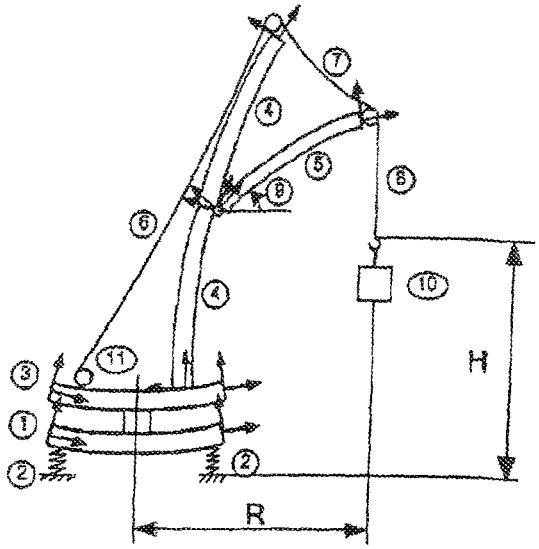
FIG. 1 shows a sketched crane model for calculating the exact position of a load lifting device.
Figure 3:
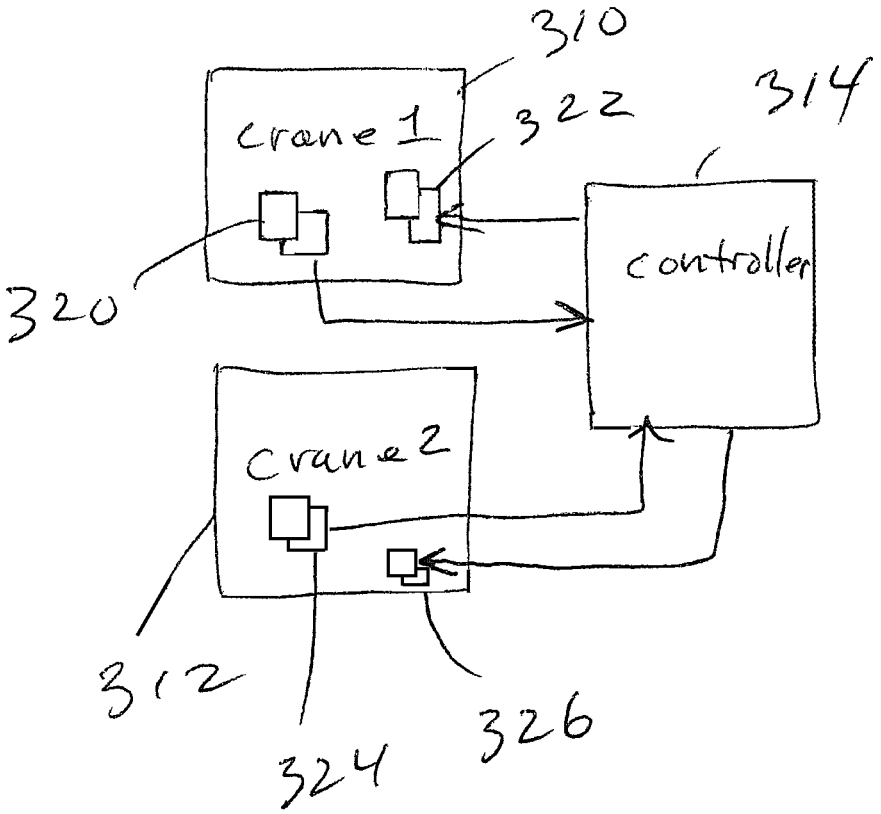
FIG. 3 shows a crane system.

The method according to the present disclosure, which is carried out by the crane controller, on the other hand pursues the approach of providing for a more exact position determination of the crane hook, in that a more realistic calculation becomes possible by taking into account one or more data characterizing the deformation of the crane. For this purpose, the crane controller provides a suitable software module which models the crane via the crane model shown in FIG. 1 by way of example. The model may be generated via force and moment balances, including system dynamics such as masses, stiffness, damping, geometry, moments of inertia, etc. The model may be simulated in real time in the controller, such as via the multi-crane system of FIG. 3, showing a first crane 310, a second crane 312 coupled to controller 314. Each crane includes sensors 320, 324, and actuators 322, 326 that may be adjusted based on the crane models and the respective stiffnesses of each of the cranes. The first and second cranes may lift a common load, or separate loads within each others workspace.

In one example, the elasticity of the supporting device 2 including the support arms and support cylinders is modeled via vertically oriented spring damper elements which are meant to simulate a resilient movement along the spring axis.

The crane body itself is modeled via a plurality of elastic beams, wherein the undercarriage 1 and the turntable 3 mounted thereon are modeled as horizontal beams and the crane tower 4 is modeled of two vertical beams put together. The boom 5 modeled as beam is luffably articulated to the crane tower 4 and extends away from the crane tower 4 proceeding from the articulation point with the boom erection angle 9 with respect to the horizontal. In addition the generated crane model takes account of the extensibility of the hoisting cable, wherein in particular a cable sag 6, 7 is assumed at the cable pieces along the crane tower and between tower and boom tip and is modeled correspondingly.

The boom erection angle 9 is detected via a measuring device arranged at the crane, in particular at the luffing gear, and communicated to the crane controller. In addition, the hook mass 10 or load mass is detected via a further measuring device and the corresponding measured values are communicated to the crane controller. The hoisting cable winch 11 provides additional information which relates to the unwound cable length of the hoisting cable. Preferably, the winch position and/or the position of one or more cable pulleys is employed for determining the cable length.

Beside the hook mass 10 and the resulting deformations of the beams, i.e. of the undercarriage 1, the turntable 3 as well as the crane tower 4 and the boom 5, and the spring or damping movement of the support system 2, the boom angle 9 determines the radius R. The hook height H then can be determined by the additional information of the cable winch 11 and the modeled cable sag 6, 7. The calculation of the corresponding boom bend of the crane components 1, 3 to 5 modeled as beams is effected by a measurement of the load hanging at the hook and the respective position.

Figure 2:
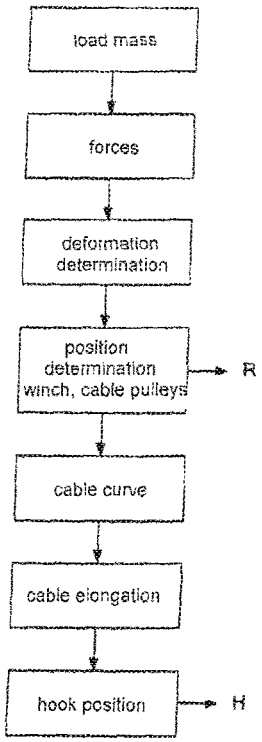
FIG. 2 shows a calculation flow diagram for determining the position of the load lifting device.

FIG. 2 shows a calculation flow diagram which shows a chronological order of the individual method steps.

At the beginning, the load mass at the crane hook 10 is determined via a measuring device. Taking into account the applied forces, in particular the weight force of the load mass, the necessary data characterizing the crane stiffness are determined by means of the crane model. The data comprising the deformation or bend of the beams of the crane components 1, 3 to 5 relate to the spring movement of the supporting device 2. By transformation of said values, the position of the crane hook 10 can be determined in radial direction R.

By means of the distance R and the additional information on the condition of the hoisting cable, the actual course of the hoisting cable, in particular possible cable curves and the cable elongation of the hoisting cable, can be simulated rather accurately and be used for calculating the height of the load above the crane floor space. Proceeding from the radial distance R and this additional information, a value H for the vertical hook height H can be determined by means of calculation.

Taking into account the deformation parameters and the exact course of the hoisting cable and its elongation leads to a position determination of the crane hook 10 which is more exact as compared to the prior art. In addition, the model-based method does not require an additional sensor unit for detecting certain parameters. Beside the load mass merely the boom erection angle 9 of the boom 5 must be determined. The measuring device necessary for this purpose usually are present anyway. By a software update of the crane controller, an existing crane system can be retrofitted for carrying out the method according to the present disclosure.

In addition, it is possible not to calculate the beam bend on all or individual beams, but determine the same via installed DMS elements, in order to then be able to supply exact measured values to the crane model.

The invention claimed is:

1. A system for a crane, comprising:

at least one measuring device at the crane supplying one or more measured values; and a crane controller having memory with instructions for control of the crane, the instructions comprising instructions for receiving the one or more measured values, calculating a position of at least one load lifting device based on the received one or more measured values and further based on a model of the crane stored in the memory of the crane controller in which an elasticity of a supporting device of an undercarriage of the crane is modeled via vertically oriented spring elements arranged at ends of the supporting device, and adjusting operation of the crane based on the calculated position.

2. The system according to claim 1, wherein the spring elements are spring damper elements.

3. The system according to claim 1, wherein in the model of the crane, individual support arms or associated support cylinders of the supporting device are modeled as resilient or damping elements.

4. A multi-crane system, comprising:

a first crane, comprising at least one measuring device at the first crane supplying one or more measured values of the first crane, and a first crane controller having memory with instructions for control of the first crane, the instructions comprising:

instructions for receiving the one or more measured values of the first crane, determining a position of at least one first load lifting device based on the received one or more measured values of the first crane, wherein a first calculation of the position of the first load lifting device is effected on the basis of the one or more measured values of the first crane and further based on a model of the first crane stored in the memory of the first crane controller, and adjusting operation of the first crane based on the calculated position, wherein the model of the first crane is based on a bend of a tower element of the first crane, a bend of a boom element of the first crane, and a spring movement of a supporting device of the first crane, and wherein the model of the first crane is further based on a cable sag and a cable elongation of at least one hoisting cable of the first crane; and a second crane coupled with the first crane.

5. The system according to claim 4, wherein the second crane and the first crane are coupled to a common load.

6. The system according to claim 5, wherein the second crane comprises at least one measuring device at the second crane supplying one or more measured values of the second crane, and a second crane controller having memory with instructions for control of the second crane, the instructions comprising:

instructions for receiving the one or more measured values of the second crane, determining a position of at least one second load lifting device based on the received one or more measured values of the second crane, wherein a second calculation of the position of the second load lifting device is effected based on the one or more measured values of the second crane and further based on a model of the second crane stored in the memory of the second crane controller, and adjusting operation of the second and first cranes based on the calculated position, wherein the model of the second crane is based on a bend of a tower element of the second crane, a bend of a boom element of the second crane, and a spring movement of a supporting device of the second crane, and wherein the model of the second crane is further based on a cable sag and a cable elongation of at least one hoisting cable of the second crane.

7. The system according to claim 4, wherein the spring movement of the supporting device of the first crane is modeled via vertically oriented spring elements only arranged at opposite ends of the supporting device.

8. The system according to claim 7, wherein the spring elements are spring damper elements.

9. A system for a crane, comprising:

at least one measuring device at the crane supplying one or more measured values; and a crane controller having memory with instructions for control of the crane, comprising:

instructions for receiving the one or more measured values, determining a position of at least one load lifting device based on the received one or more measured values, wherein a calculation of the position of the load lifting device is effected based on the one or more measured values and further based on a model of the crane stored in the memory of the crane controller, and adjusting operation of the crane based on the calculated position, wherein the model of the crane is based on a bend of a tower element, a bend of a boom element, and a spring movement of a supporting device, wherein the spring movement of the supporting device is modeled via vertically oriented spring elements arranged at ends of the supporting device, and wherein the model of the crane is further based on a cable sag and a cable elongation of at least one hoisting cable.

10. The system according to claim 9, wherein the at least one measuring device of the crane comprises one or more strain gauges.

11. The system according to claim 10, wherein at least one strain gauge is arranged at the boom element.

12. The system according to claim 10, wherein at least one strain gauge is arranged at the tower element.

13. The system according to claim 9, wherein the at least one measuring device comprises a sensor unit at a retracting mechanism for measuring an unwound cable length and/or at least one sensor unit at a luffing gear for measuring an erection angle.

14. The system according to claim 9, wherein in the model of the crane, the crane is modeled via a plurality of elastic beams.

15. The system according to claim 9, wherein in the model, the boom element is modeled as a beam.

16. The system according to claim 9, wherein in the model, the tower element is modeled as a beam.

17. The system according to claim 9, wherein the tower element is a first tower element, wherein in the model, an undercarriage of the crane and a turntable mounted thereon are each modeled as horizontal beams, and wherein the first tower element and a second tower element are modeled as two vertical beams put together.

18. The system according to claim 9, wherein the spring elements are spring damper elements.

19. The system according to claim 9, wherein in the model of the crane, individual support arms or associated support cylinders of the supporting device are modeled as resilient or damping elements.

* * * * *